US006765542B2

(12) United States Patent
McCarthy et al.

(10) Patent No.: US 6,765,542 B2
(45) Date of Patent: Jul. 20, 2004

(54) MULTIBAND ANTENNA

(75) Inventors: Robert Daniel McCarthy, Newbury Park, CA (US); Douglas Tien Lai, Oxnard, CA (US)

(73) Assignee: Andrew Corporation, Orland Park, IL (US)

( * ) Notice: Subject to any disclaimer, the term of this patent is extended or adjusted under 35 U.S.C. 154(b) by 8 days.

(21) Appl. No.: 10/252,458

(22) Filed: Sep. 23, 2002

(65) Prior Publication Data

US 2004/0056822 A1 Mar. 25, 2004

(51) Int. Cl.[7] ..... H01Q 1/36
(52) U.S. Cl. ..... 343/895; 343/700 MS
(58) Field of Search ..... 343/895, 700 MS, 343/873, 789; H01Q 1/36

(56) References Cited

U.S. PATENT DOCUMENTS

| | | | | |
|---|---|---|---|---|
| 3,039,099 A | | 6/1962 | Chait et al. | |
| 3,828,351 A | * | 8/1974 | Voronoff | 343/740 |
| 3,925,784 A | | 12/1975 | Phelan | |
| 3,949,407 A | | 4/1976 | Jadgmann et al. | |
| 4,912,481 A | | 3/1990 | Mace et al. | |
| 5,087,922 A | | 2/1992 | Tang et al. | |
| 5,300,936 A | | 4/1994 | Izadian | |
| 5,451,973 A | * | 9/1995 | Walter et al. | 343/895 |
| 5,541,617 A | | 7/1996 | Connolly et al. | |
| 5,621,422 A | | 4/1997 | Wang | |
| 5,838,282 A | | 11/1998 | Lalezari et al. | |
| 5,955,997 A | | 9/1999 | Ho et al. | |
| 6,166,694 A | | 12/2000 | Ying | |
| 6,181,277 B1 | | 1/2001 | Kesler et al. | |
| 6,201,513 B1 | | 3/2001 | Ow et al. | |
| 6,208,312 B1 | | 3/2001 | Gould | |
| 6,252,559 B1 | | 6/2001 | Donn | |
| 6,323,820 B1 | | 11/2001 | Haunberger | |

FOREIGN PATENT DOCUMENTS

| | | |
|---|---|---|
| JP | 2000269736 | 9/2000 |
| WO | WO 01/13465 A1 | 2/2001 |

OTHER PUBLICATIONS

Paper of E. Gschwendtner and W. Wiesebeck, "Low–Cost Spiral Antenna with Dual–Mode Radiation Pattern for Integrated Radio Services", available at www.comcar.de/papers/ap2000.pdf.

* cited by examiner

*Primary Examiner*—Hoanganh Le
(74) *Attorney, Agent, or Firm*—Welsh & Katz, Ltd.

(57) ABSTRACT

A multi-band antenna comprising two or more low frequency radiators dimensioned to operate in a low frequency band, and two or more high frequency radiators dimensioned to operate in a high frequency band. Each high frequency radiator is substantially coplanar with the low frequency radiators, and is formed in a spiral with the high and low frequency radiators interleaved. A hybrid feed network has two or more antenna ports, each antenna port being coupled with a low frequency radiator and a high frequency radiator. The antenna can be used for receiving GPS L1/L2 signals. The antenna is configured to send and/or receive circularly polarized radiation.

46 Claims, 5 Drawing Sheets

MULTIBAND ANTENNA

FIELD OF THE INVENTION

The invention relates to a multiband antenna, typically for receiving Global Positioning System (GPS) signals.

BACKGROUND OF THE INVENTION

Conventional two arm frequency independent Archimedean spiral antennas used to receive GPS L1/L2 signals exhibit poor group delay (d/df) variation performance over the hemispherical coverage required, and low efficiency. The variation rises from the movement of the active radiating region over the bandwidth of the GPS signal, multiple regions radiating beyond the primary region, and the use of only two ports. This variation degrades the performance of the system, requiring corrections in software to offset the variation. The variation is also undesirable in GPS surveying applications where low group delay variation is critical to obtain extremely accurate GPS locations. Low efficiency causes difficulty in acquiring low angle satellite signals and arises from the balun assembly needed to feed the two spiral ports, and current losses in the arms before reaching the radiating region.

WO 01/13465 (Kunysz) discloses an aperture coupled slot array antenna. Energy is coupled into each slotted opening by a transmission line in the shape of a circular arc. An impedance load is coupled to a terminal end of the transmission line to provide a leaky-wave antenna configuration and to thus ensure a uniform amplitude coupling to all slotted openings.

U.S. Pat. No. 3,949,407 (Jagdmann) discloses a spiral antenna in which the outer ends of the spiral arms are direct fed by a hybrid feed network. A multi-band antenna is disclosed with interleaved sets of low frequency and high frequency slotted openings.

U.S. Pat. No. 6,181,277 (Kesler) discloses a dual frequency microstrip patch antenna. A top microstrip patch element is separated from the ground plane by a larger second microstrip patch element. The top microstrip patch element is driven by a feed network consisting of three hybrid couplers.

U.S. Pat. No. 5,621,422 (Wang) discloses a two arm spiral-mode microstrip antenna in which the spiral arms are driven by a hybrid circuit with either 0 degree or 180 degree phase shift between the two arms.

U.S. Pat. No. 5,838,282 (Lalezari) discloses a multi-frequency antenna in which high frequency and low frequency radiating elements are each driven by respective feed circuits. A stacked patch antenna operates in a first frequency band and a crossed dipole element operates in a second frequency band.

U.S. Pat. No. 3,039,099 (Chait) discloses a linearly polarized spiral antenna system. Two spiral arms are coupled at both ends to a drive circuit.

U.S. Pat. No. 6,166,694 (Ying) discloses a printed twin spiral dual band antenna. A single (relatively long) low frequency spiral arm and a single (relatively small) high frequency spiral arm are coupled with a feeding pin, matching bridge, loading resistor and grounded post.

U.S. Pat. No. 3,925,784 (Phelan) discloses a 4-arm spiral antenna with inner ends coupled to a network of diodes, and outer ends coupled to switches.

U.S. Pat. No. 5,300,936 (Izadian) discloses a multiple band antenna, including one embodiment (FIG. 8) in which an array of four longitudinal radiating elements form two orthogonal dipole pairs. Hybrid circuits provide output signals in response to illumination of the dipole pairs.

U.S. Pat. No. 4,912,481 (Mace) discloses a multi-frequency antenna array in which an array of patches operable at high frequencies define a rectangular grid which is operable at low frequencies.

The paper E. Gschwendtner, W. Wiesebeck, "Low-Cost Spiral Antenna with Dual-Mode Radiation Pattern for Integrated Radio Services", available at www.comcar.de/papers/ap2000.pdf describes a four arm spiral antenna with a coplanar waveguide transmission line connected to the centre of the spiral.

U.S. Pat. No. 5,541,617 (Connolly) discloses a quadrifilar helix antenna in which a 180 hybrid circuit drives the four radiating elements.

U.S. Pat. No. 5,955,997 (Ho) discloses a microstrip-fed cylindrical slot antenna. The antenna is driven by a non-isolating inline power splitter with an excess quarter-wavelength line in one output arm which generates the required 90 degrees phase differentials between the radiating slots.

U.S. Pat. No. 6,201,513 (Ow) discloses a two-arm spiral antenna driven by a two port balun assembly.

It is an object of the invention to provide an alternative antenna and feed network configuration with improved characteristics, or at least to provide a useful alternative.

BRIEF DESCRIPTION OF EXEMPLARY EMBODIMENT

A first aspect of the exemplary embodiment provides a multi-band antenna comprising two or more low frequency radiators dimensioned to operate in a low frequency band; two or more high frequency radiators dimensioned to operate in a high frequency band, each high frequency radiator being substantially coplanar with the low frequency radiators; and a hybrid feed network having two or more antenna ports, each antenna port being coupled with one or more of the radiators.

A second aspect of the exemplary embodiment provides a multi-band antenna comprising two or more low frequency radiators dimensioned to operate in a low frequency band; two or more high frequency radiators dimensioned to operate in a high frequency band; and a feed network having two or more antenna ports, wherein each antenna port is coupled with a low frequency radiator and a high frequency radiator.

BRIEF DESCRIPTION OF THE DRAWINGS

The accompanying drawings which are incorporated in and constitute part of the specification, illustrate embodiments of the invention and, together with the general description of the invention given above, and the detailed description of the embodiments given below, serve to explain the principles of the invention.

DETAILED DESCRIPTION OF EMBODIMENTS OF THE INVENTION

Figure 1:
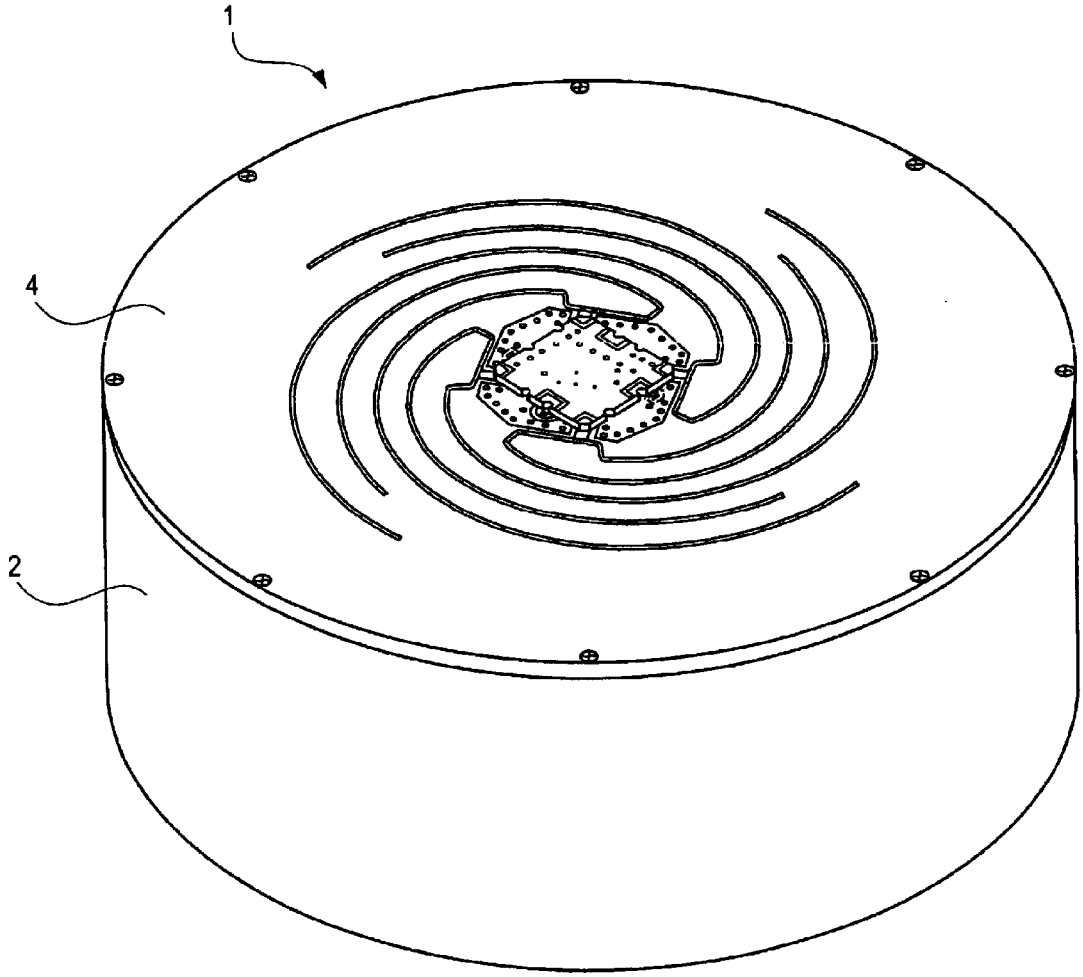
FIG. 1 is a perspective view of an antenna.
Figure 2:
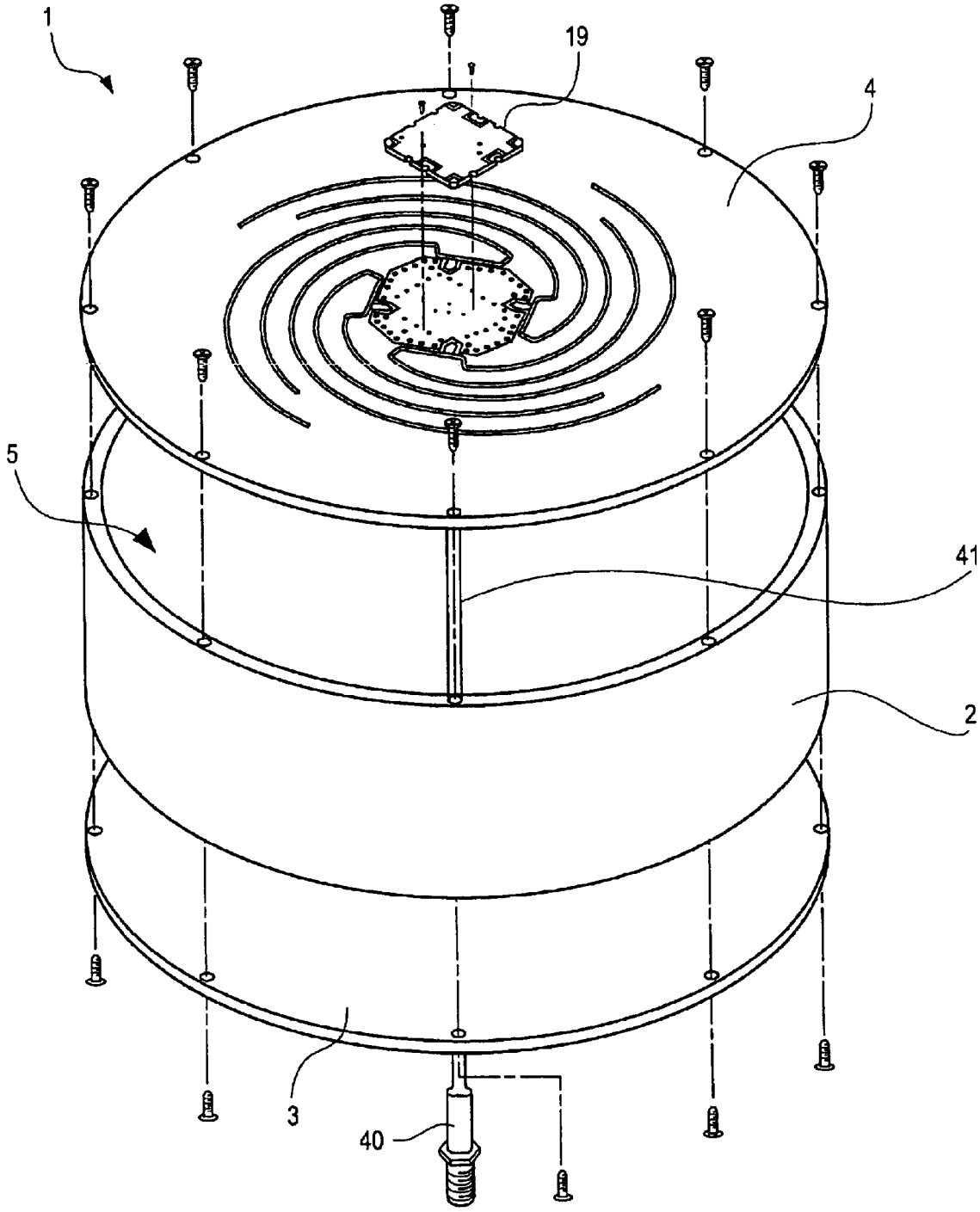
FIG. 2 is an exploded view of the antenna of FIG. 1.
Figure 3:
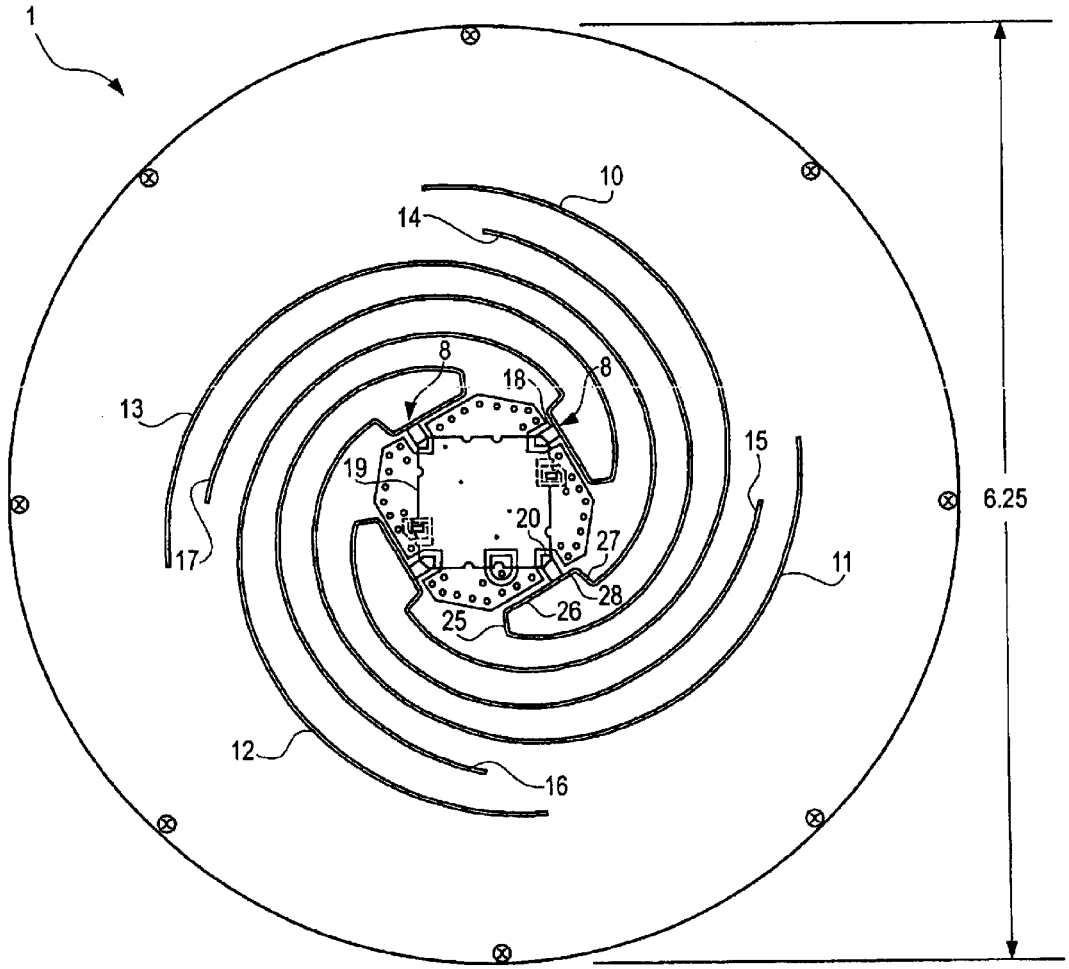
FIG. 3 is a plan view of the antenna of FIG. 1.

Referring to FIGS. 1–3, the structure of the antenna 1 is formed by a cylindrical metal side wall 2, metal disc 3 which forms the antenna ground plane, and a thin, low dielectric constant substrate 4. The cylindrical cavity 5 formed by wall 2 and discs 3,4 is empty. The upper surface of disc 4 is initially coated in a continuous layer of metal, which is etched away to leave the pattern shown in FIGS. 1–3.

Referring to the plan view of FIG. 3, the pattern comprises a first set of four low-frequency arms 10–13 interleaved with a second set of four high-frequency arms 14–17. The arms 10–13 are relatively long and are resonant at the lower L2 Global Positioning System (GPS) frequency of 1227.6 MHz. The arms 14–17 are relatively short and are resonant at the higher L1 GPS frequency of 1575.42 MHz. The ground plane disc 3 is spaced by a distance corresponding to approximately ½ or ¼ of the L1/L2 wavelengths.

The arms 10–17 are divided into four pairs, each pair branching out from a common respective power splitter junction (an exemplary junction being labelled 8 in FIG. 3). The physical geometry of the antenna arms 10–17 will now be described with reference to exemplary arms 14 and 13. Arm 14 has a radially extending straight portion 25 and a straight portion 26 extending tangentially from the power splitter junction 8. Arm 13 has a radially extending straight portion 27 and a straight portion 28 extending tangentially from the power splitter junction. The arms are formed in a spiral, with the curved portions of the longer low frequency arms 10–13 subtending an angle of approximately 230 degrees, and the curved portions of the shorter low frequency arms 14–17 subtending an angle of approximately 170 degrees.

The power splitter input lines 18 are each soldered to a respective antenna port of a feed network 19. One of the antenna ports is labelled at 20 in FIG. 1.

Figure 4:
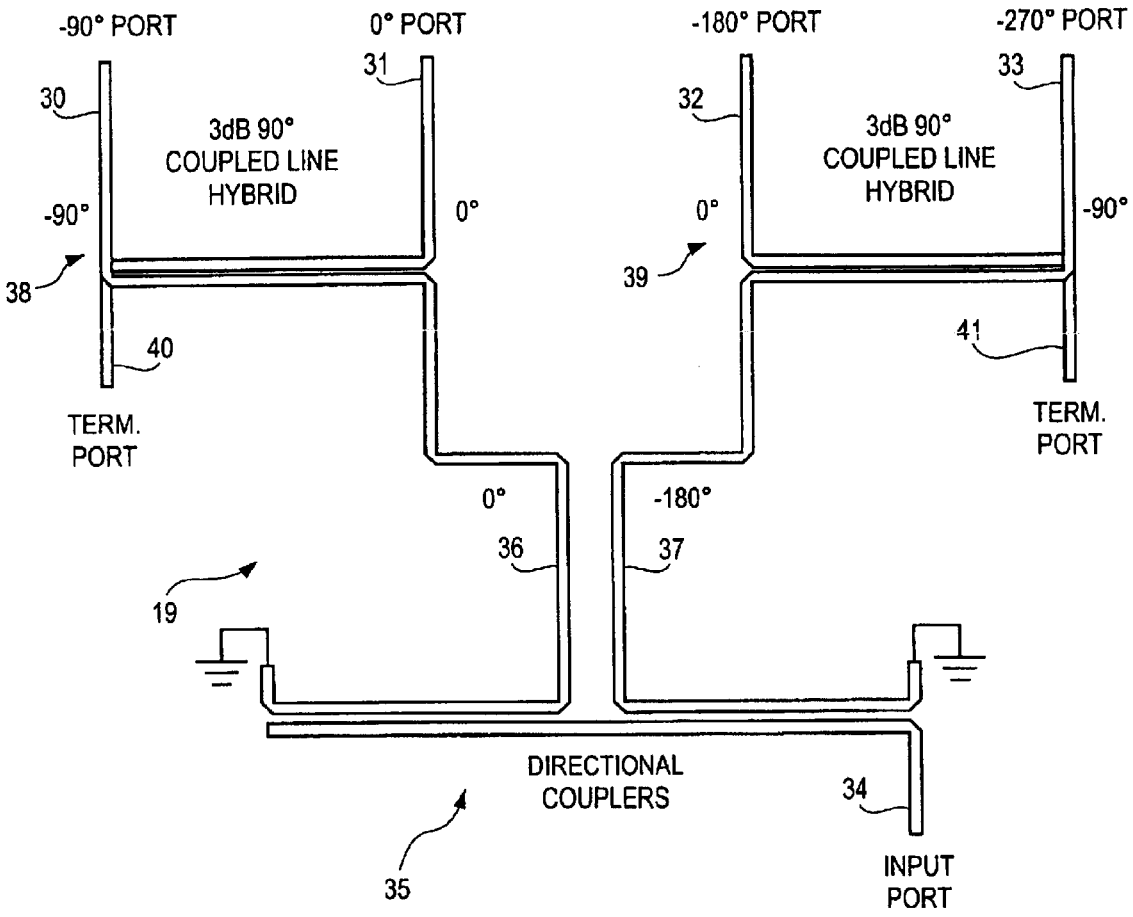
FIG. 4 is a circuit diagram of the feed network.

Referring to FIG. 4, the feed network 19 is a monolithic Anaren Xinger™ delay line chip, model no. 21B1305 having a −90 degree port 30, 0 degree port 31, −180 degree port 32, −270 degree port 33, and input port 34. An incoming signal on input port 34 is divided into two equal signals, offset by 180 degrees, by a directional coupler 35 on 0 degree line 36 and −180 degree line 37. The 0 degree signal is input to a 3 dB 90 degree coupled line hybrid 38 and the −180 degree signal is input to a 3 dB 90 degree coupled line hybrid 39. The 90 degree and −90 degree output lines of hybrids 38,39 form the four antenna ports 30–33. The fourth ports 40,41 of hybrids 38,39 are terminated. Thus a signal input to input port 34 is divided into four equal amplitude signals each having a quadrature phase offset, thus resulting in a circularly polarized radiation beam.

Input/output signals are transmitted to/from the port 34 by via an SMA connector 40 and transmission line 41 (FIG. 2). The connector 40 is coupled to a receiver or low noise amplifier (not shown).

Figure 5:
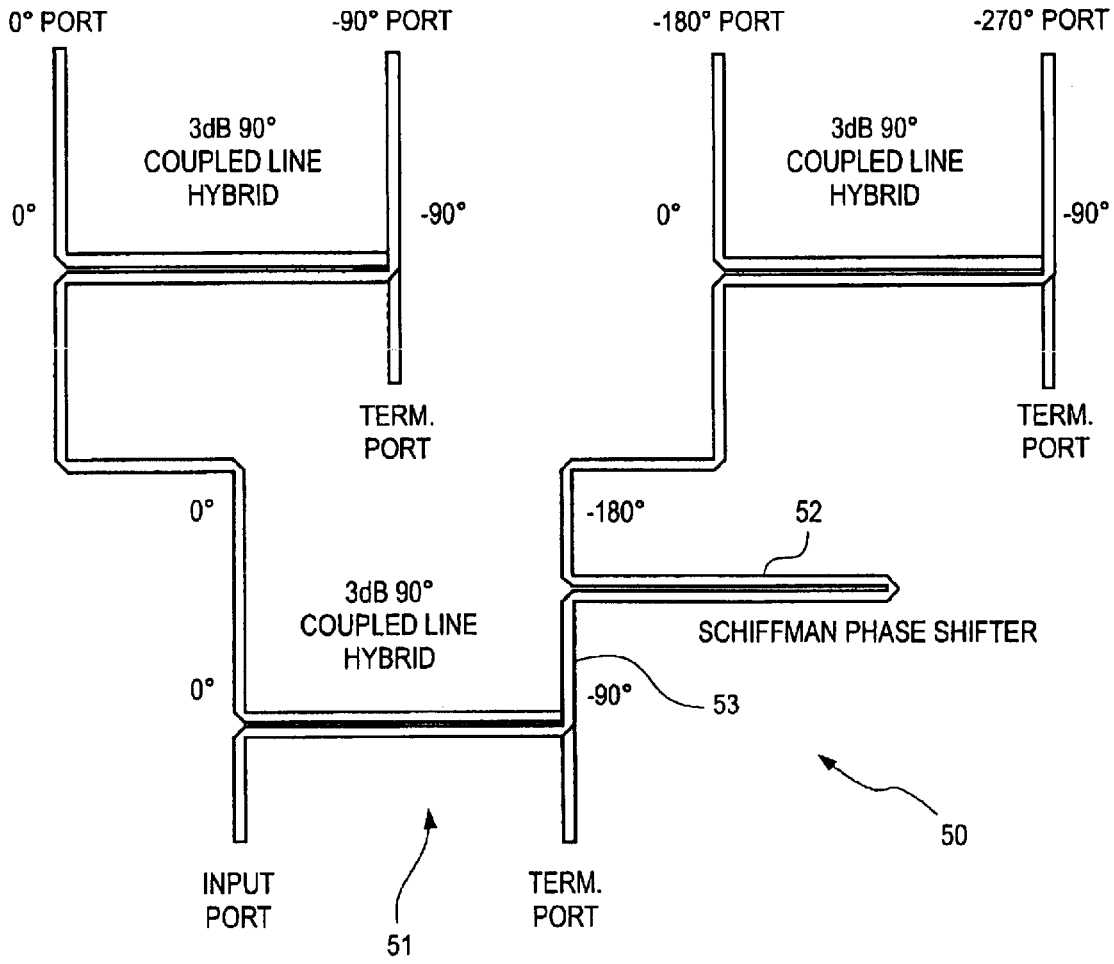
FIG. 5 is a circuit diagram of an alternative feed network.

An alternative feed network 50 is shown in FIG. 5. The network is identical to the network 19 of FIG. 4, except that the directional coupler 35 is replaced by a 3 dB 90 degree coupled line hybrid 51 with a Schiffman phase shifter 52 to alter the −90 degree leg 53 by a further 90 degrees.

Both feed networks 19 and 50 are fabricated using stripline techniques. This is relatively expensive (compared with microstrip techniques) but much broader frequency response is the payoff.

The use of hybrid feed networks 51,35 results in improved efficiency and simpler production compared with the two port balun assembly described in U.S. Pat. No. 6,201,513 (Ow). The feed networks provide a direct path to the resonant arms, minimising current losses. Radiation pattern performance is well suited to satellite communications.

By coupling a low frequency arm and a high frequency arm with each antenna port via a power splitter, the antenna only requires a single four port hybrid feed network to drive all eight arms.

The antenna has extremely low group delay variation due to the four arm structure, and lack of multiple radiation regions.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

For instance, the arms 10–17 may be replaced by slotted openings as described in WO 01/13465 (Kunysz). Frequency of operation and impedance can be altered by adjusting the arm length and pitch angle.

Although the preferred embodiment is operated in receive mode for receiving satellite GPS signals, the antenna could also be operated in transmit mode for other applications. The antenna could also be operated in both transmit and receive mode, either simultaneously or alternately. Thus it will be understood that the term "radiating element" in the appended claims refers to an element which can transmit and/or receive electromagnetic energy.

The invention may be utilised with other radiator constructions: for instance an array of dipoles or patch elements, or a quadrifilar helix.

What is claimed is:

1. A multi-band antenna comprising two or more low frequency radiators dimensioned to operate in a relatively low frequency band; two or more high frequency radiators dimensioned to operate in a relatively high frequency band, each high frequency radiator being substantially coplanar with the low frequency radiators; and a hybrid feed network having two or more antenna ports, each antenna port being coupled with one or more of the low frequency and high frequency radiators and where the low frequency and high frequency radiators coupled to the ports further comprise at least one low frequency radiator and at least one high frequency radiator.

2. An antenna according to claim 1, wherein the low and high frequency radiators are spiral arms, with the low frequency spiral arms being interleaved with the high frequency spiral arms.

3. An antenna according to claim 2 wherein the spiral arms have curved portions which subtend an angle less than 360 degrees.

4. An antenna according to claim 2 wherein the low and/or high frequency arms include a tangentially extending straight portion.

5. An antenna according to claim 1 wherein the radiators comprise conducting arms.

6. An antenna according to claim 1 wherein each antenna port of the feed network is at a different phase.

7. An antenna according to claim 1 wherein the antenna is configured to send and/or receive circularly polarized radiation.

8. An antenna according to claim 1 wherein the feed network has four or more antenna ports.

9. An antenna according to claim 1 comprising four or more low frequency radiators, and four or more high frequency radiators.

10. An antenna according to claim 9 consisting of four low frequency radiators, and four high frequency radiators.

11. An antenna according to claim 1 wherein the low and high frequency radiators are elongated along respective lengths, and wherein the length of the low frequency radiators is greater than the length of the high frequency radiators.

12. An antenna according to claim 1 wherein the radiators extend outwardly from a common central region.

13. An antenna according to claim 12 wherein the radiators have inner ends proximate to the central region which are coupled to the feed network.

14. An antenna according to claim 1 configured to receive GPS signals.

15. An antenna according to claim 1 wherein the feed network comprises a first power divider having an input port and first and second output lines which are phase offset, second and third power dividers each having an input line and first and second output ports which are phase offset, wherein the input line of the second power divider is coupled to the first output line of the first power divider, and the input line of the third power divider is coupled to the second output line of the first power divider.

16. An antenna according to claim 15 wherein the second and third power dividers comprise hybrid circuits.

17. An antenna according to claim 16 wherein the hybrid circuits are coupled line hybrid circuits.

18. An antenna according to claim 1 wherein the feed network includes one or more coupled line hybrid circuits.

19. An antenna according to claim 15 wherein the first power divider comprises a directional coupler.

20. An antenna according to claim 15 wherein the first power divider comprises a hybrid circuit.

21. An antenna according to claim 1 wherein the radiators are microstrip or stripline radiators.

22. An antenna according to claim 1 including a ground plane spaced from the radiators by a distance which is less than the resonant wavelength of the high frequency radiators.

23. An antenna according to claim 1 wherein the radiators are positioned adjacent to a cavity defined by a ground plane and conductive side walls.

24. A multi-band antenna comprising two or more low frequency radiators dimensioned to operate in a relatively low frequency band; two or more high frequency radiators dimensioned to operate in a relatively high frequency band; and a feed network having two or more antenna ports, wherein each antenna port is coupled with a low frequency radiator and a high frequency radiator.

25. An antenna according to claim 24, wherein the low and high frequency radiators are spiral arms, with the low frequency spiral arms being interleaved with the high frequency spiral arms.

26. An antenna according to claim 25 wherein the spiral arms have curved portions which subtend an angle less than 360 degrees.

27. An antenna according to claim 25 wherein the low and/or high frequency arms include a tangentially extending straight portion.

28. An antenna according to claim 24 wherein the radiators comprise conducting arms.

29. An antenna according to claim 24 wherein each antenna port of the feed network is at a different phase.

30. An antenna according to claim 24 wherein the antenna is configured to send and/or receive circularly polarized radiation.

31. An antenna according to claim 24 wherein the feed network has four or more antenna ports.

32. An antenna according to claim 24 comprising four or more low frequency arms, and four or more high frequency arms.

33. An antenna according to claim 32 consisting of four low frequency arms, and four high frequency arms.

34. An antenna according to claim 24 wherein the low and high frequency radiators are elongated along respective lengths, and wherein the length of the low frequency radiators is greater than the length of the high frequency radiators.

35. An antenna according to claim 24 wherein the radiators extend outwardly from a common central region.

36. An antenna according to claim 24 wherein the radiators have inner ends proximate to the central region which are coupled to the feed network.

37. An antenna according to claim 24 configured to received GPS signals.

38. An antenna according to claim 24 wherein the feed network comprises a first power divider having an input port and first and second output lines which are phase offset, second and third power dividers each having an input line and first and second output ports which are phase offset, wherein the input line of the second power divider is coupled to the first output line of the first power divider, and the input line of the third power divider is coupled to the second output line of the first power divider.

39. An antenna according to claim 38 wherein the second and third power dividers comprise hybrid circuits.

40. An antenna according to claim 39 wherein the hybrid circuits are coupled line hybrid circuits.

41. An antenna according to claim 24 wherein the feed network includes one or more coupled line hybrid circuits.

42. An antenna according to claim 38 wherein the first power divider comprises a directional coupler.

43. An antenna according to claim 38 wherein the first power divider comprises a hybrid circuit.

44. An antenna according to claim 24 wherein the radiators are microstrip or stripline radiators.

45. An antenna according to claim 24 including a ground plane spaced from the radiators by a distance which is less than the resonant wavelength of the high frequency radiators.

46. An antenna according to claim 24 wherein the radiators are positioned adjacent to a cavity defined by a ground plane and conductive side walls.

* * * * *